United States Patent [19]

MacLean

[11] 4,133,020

[45] Jan. 2, 1979

[54] CONTROL SWITCH RELAY AND CONTROL CIRCUIT MEANS

[75] Inventor: Alexander MacLean, Hingham, Mass.

[73] Assignee: Electro Switch Corp., Weymouth, Mass.

[21] Appl. No.: 811,198

[22] Filed: Jun. 29, 1977

Related U.S. Application Data

[60] Continuation-in-part of Ser. No. 729,114, Oct. 4, 1976, Pat. No. 4,106,072, which is a division of Ser. No. 591,170, Jun. 27, 1975, Pat. No. 4,001,740.

[51] Int. Cl.[2] ..... H01H 47/02

[52] U.S. Cl. ..... 361/156; 335/190; 361/166; 361/191

[58] Field of Search ..... 361/156, 166, 191, 194, 361/195; 335/186, 190

[56] References Cited

U.S. PATENT DOCUMENTS

| | | | |
|---|---|---|---|
| 3,801,876 | 4/1974 | Lotspeich | 361/189 |
| 4,001,740 | 1/1977 | MacLean | 335/190 X |

*Primary Examiner*—Harry E. Moose, Jr.
*Attorney, Agent, or Firm*—Wolf, Greenfield & Sacks

[57] ABSTRACT

A control switch has a switch shaft carrying radially positioned contacts and mounted for reciprocal rotational movement about its axis. A cam profile is fixed to the shaft and has first and second opposed cam surfaces. A driver is mounted to selectively engage the first or second cam surface to drive the switch shaft into a first clockwise position or a second counterclockwise position by remote actuation. The driver is connected to a rotary solenoid and a linear solenoid which allow unidirectional drive translated into two directional drive by the driver.

One form of control circuit operates a rotary solenoid and a linear solenoid through a trip and close switch. A first relay is responsive to actuation of the trip switch means or close switch means to energize the rotary solenoid and index the switch shaft to a preselected position holding that position for a preselected time after which the shaft returns to its original position regardless of whether or not the trip switch or close switch are deactuated. A second relay denenergizes the first relay means after a preselected time preventing further operation of the first relay means and therefore the solenoid, until the trip or close switch is deactuated.

In still another control circuit, the first relay is responsive to actuation of the trip switch or close switch to energize the rotary solenoid and index the shaft to a preselected position. A second relay maintains electrical power to the rotary solenoid holding the shaft in the preselected position until such time as the switch means are deactuated. The rotary solenoid operation is responsive to the operation of and follows the trip and close switches.

15 Claims, 12 Drawing Figures

FIG. 1
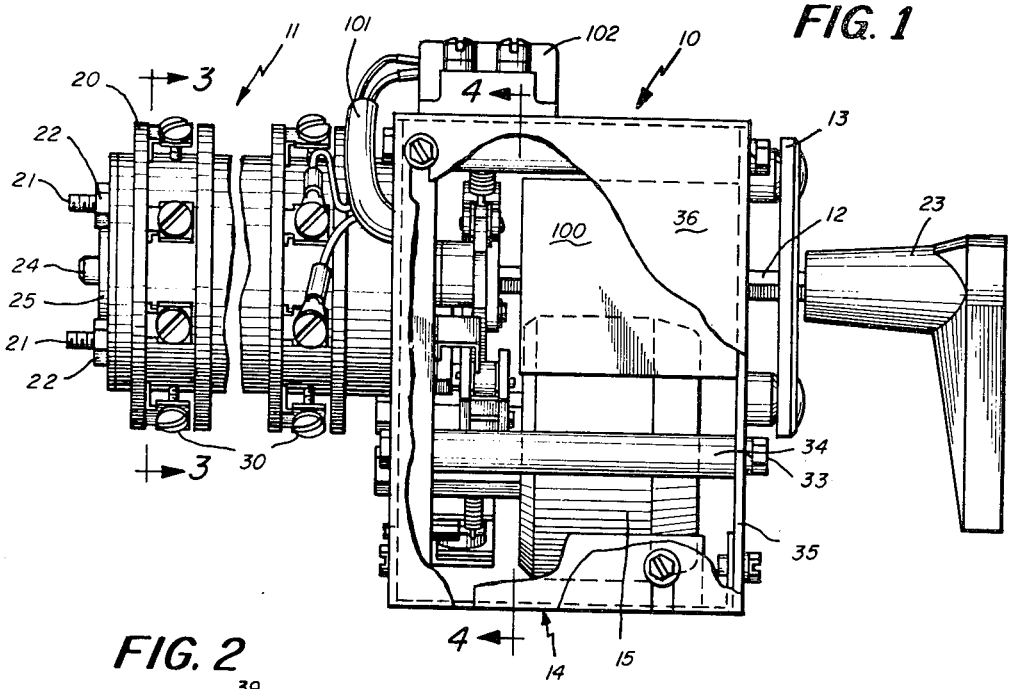
FIG. 2
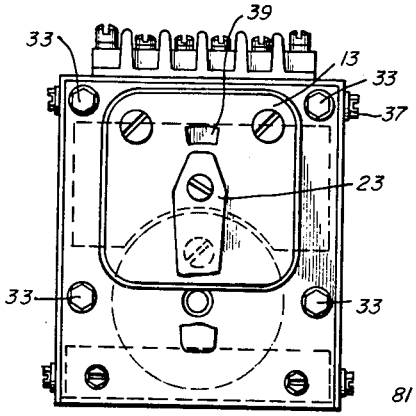
FIG. 4
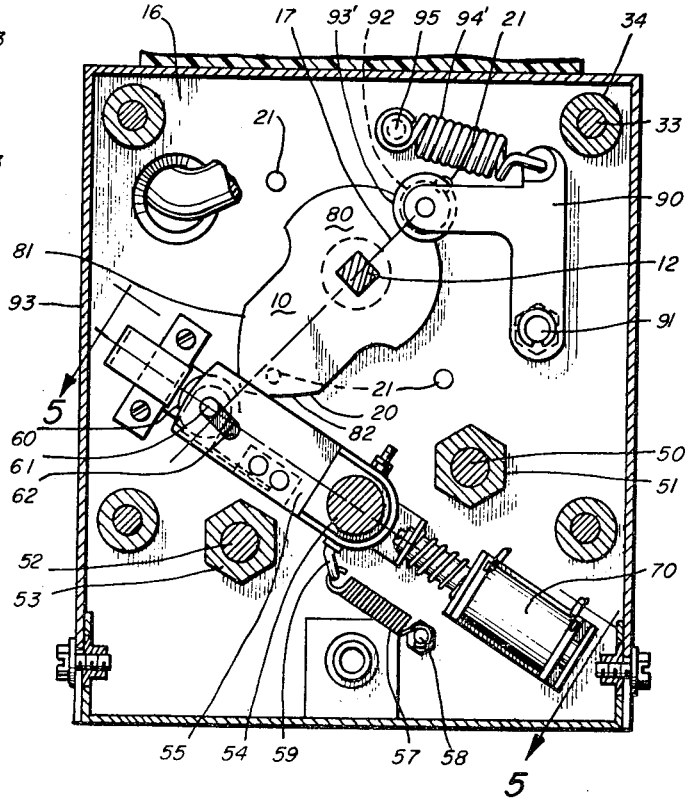
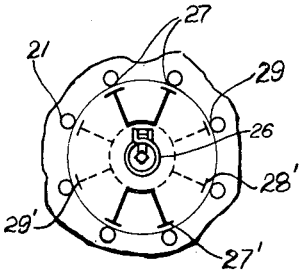
FIG. 3

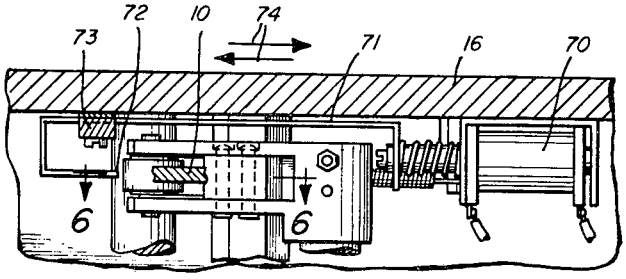
FIG. 5
FIG. 6
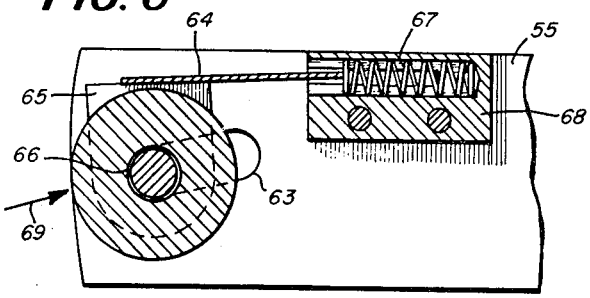
FIG. 10
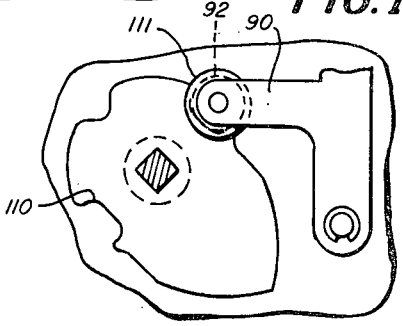
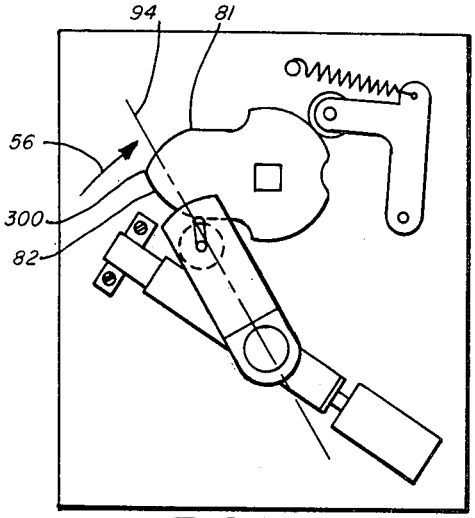
FIG. 7
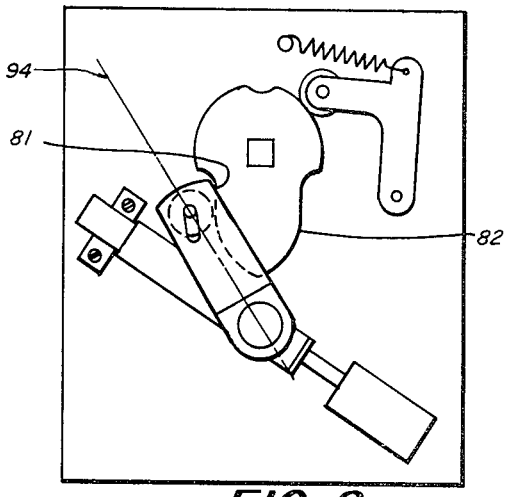
FIG. 8
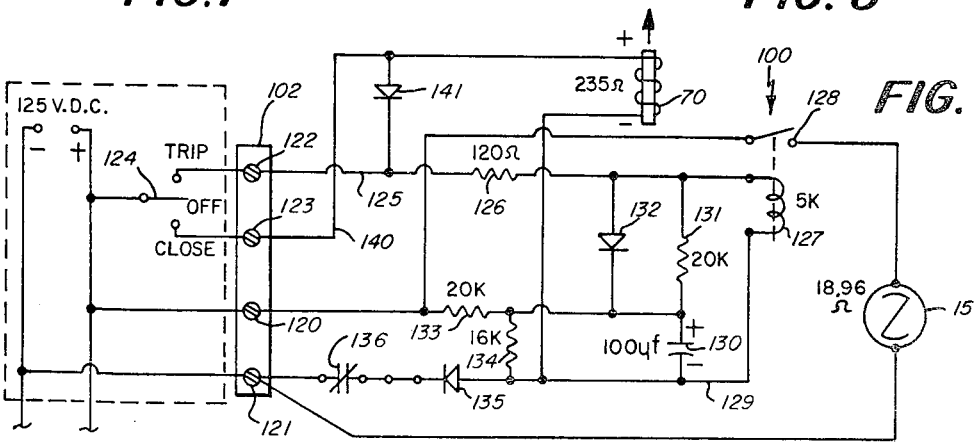
FIG. 9

125V.D.C.

200
202
222
223
TRIP
OFF
CLOSE
224
241
251
210
211
212
240
1W
213
217
20K
1W
250
235Ω
70
25μf
214
216
215
240
H
A
G
B
F
C
E
D
10
220
221
15

125V.D.C.

300
302
324
322
TRIP
325
OFF
CLOSE
323
330
240Ω 1W
331
334
25μf
342
235Ω
70
341
332
333
320
75Ω
50W
321
340
326
15
335
H
A
G
B
F
C
E
D
10

CONTROL SWITCH RELAY AND CONTROL CIRCUIT MEANS

RELATED APPLICATIONS

This application is a continuation-in-part of U.S. application Ser. No. 729,114, filed Oct. 4, 1976 now U.S. Pat. No. 4,106,072 dated Aug. 8, 1978 which is in turn a division of application Ser. No. 591,170, filed June 27, 1975, now U.S. Pat. No. 4,001,740 dated Jan. 4, 1977.

BACKGROUND OF THE INVENTION

Manually operated control switches are well-known for use by electric utility industries. Such control switches sometimes referred to as circuit breakers and control switches, are used as a primary means of manually tripping out circuit breakers to isolate a power highline from an overall distribution system. The same control switch is often used as the primary means of manually closing or reclosing a power circuit breaker. Such control switches are normally panel mounted in large groups on predrilled panels and have handle shafts extending through the panel for manual operation at the panel. Often such switches provide up to fourteen 30 amp contacts that can be operated in one of three positions. Typically, these are trip, neutral and close or 315 degrees, 0 degrees and 45 degrees, respectively. The switch is at rest in the neutral position (0 degrees) maintained by a spring load. From this position the switch can be turned 45 degrees to either the trip or close position depending upon the function required. Such counterclockwise or clockwise turning is against a resilient spring load in either direction so that the handle is always resiliently biased to return to the neutral position. Typically, the operation of the switches in either tripping or closing is very quick, often only a few seconds. Thus the control switch need only be manually held out of the neutral position against the spring load for a few seconds to do its job and then be allowed to return to the neutral position. Such positional contacts are considered momentary contacts; thus, they only close for a moment and then open. Occasionally a fourth position is supplied at 270 degrees as in a syncroscope switch; however, the contacts for the fourth position are maintained by a locking detent that prevents the switch from returning to neutral.

The wide use of these control switches throughout industry has created a great many panel installations. Thus panels throughout the country are drilled, switches are mounted and wiring established. Installation or replacement of such systems today would require significant costs. Because of certain technological advances, it has become important for the industry to change the old systems over from a manual control at the switch site to enable such switches to be automatically or remotely controlled as well as manually controlled at the switch site. Thus, there is a need in the industry for a control switch that can be both manually actuated at the switch and/or automatically controlled from a remote location, which switch would be sized to fit existing panel installations with no or minimum modifications. There is a further need for control circuits for remote operation of such switches.

SUMMARY OF THE INVENTION

It is an object of this invention to provide control circuits for a control switch relay which control circuit allows interruption of rotary solenoid power while avoiding problems associated with excessive arcing.

Another object of this invention is to provide control circuits in accordance with the preceding object which provide for the use of a low power command signal and have provision for limiting the time of rotary solenoid operation to prevent damage due to overheating.

Still another object of this invention is to provide a control circuit which automatically upon closure of an actuating switch causes a control switch relay to index to a desired position, remain there for a preselected time and then automatically return to its off position.

Still another object of this invention is to provide a control circuit for a control switch relay which causes indexing of the control switch relay to a desired position upon actuation of either one of two switches and permits deactuation of the switch relay to an off position when the actuated switch is opened.

It is still another object of this invention to provide control circuits in accordance with the two preceding objects which circuits eliminate the possibility of overheating and overstressing of a rotary solenoid used in connection with a control switch relay and which prevent unwanted repeat cycling of the control switch relay.

The preferred control switch used with the control circuits of this invention has a switch shaft mounted for reciprocal rotational movement about its axis from a first rest position to a second clockwise position and a third counterclockwise position. A cam profile means if fixed to the shaft and has first and second opposed cam surfaces. Means are provided for retaining the cam profile means with the switch shaft in the first rest position. Drive means comprises a means for selectively engaging the first and second cam surfaces to drive the switch shaft to the second and third positions respectively. The drive means further comprises a uni-directional rotary solenoid providing arcuate reciprocation of a drive arm. Preferably the drive arm carries a drive roller having an axis parallel to the switch shaft which roller is mounted for movement into operative relationship with the first or second cam surface as may be selected. Preferably a linear solenoid is provided for moving the drive roller to the desired operative engagement.

A first control circuit for the control switch relay has rapid actuation and slow release of the rotary solenoid as will be described.

A second control circuit means for operating a remote control switch which has a rotary solenoid linked to a switch shaft carrying radially positioned contacts, and a linear solenoid. A trip switch means and a close switch means are linked to the control circuit. A first relay means is responsive to actuation of the trip means and/or close means to actuate the rotary solenoid and index the shaft to a preselected position holding the position for a preselected time and then automatically returning to its original position regardless of whether or not the trip switch means and close switch means are deactuated. A second relay is provided for deenergizing the first relay means to protect the rotary solenoid.

A third control circuit means for operating a remote control switch comprises a rotary solenoid and a linear solenoid with the control circuit means having a first relay means responsive to actuation of a trip switch means or a close switch means to energize the rotary solenoid and index the shaft to a preselected position. Another relay means maintains the shaft in the preselected position by maintaining electrical power to the rotary solenoid until the switch means are deactuated whereby the rotary solenoid actuation and deactuation is responsive to the operation of the trip and close switch means.

It is a feature of this invention that there is no direct mechanical linkage between the conventional switch shaft and remote drive mechanisms so that failure of the remote mechanism does not impair the ability of the switch to be manually operated. The control circuits avoid switching and arcing problems normally associated with rotary solenoids usage. For remote control the command signal needed can be low power thus eliminating line losses due to $I^2R$ over long cable runs. When using the first control circuit, the trip and close switches are preferably only closed for a short period as for example one second maximum for proper operation of the control switch relay. A one second pulse causes the switch to index to the desired position remain for perhaps 3 seconds after which it will spring return to off. If the trip and close switches are still closed, the control switch relay will operate again repeating the cycle and this is called pumping which can overheat the solenoid and cause some damage. Thus circuit A is preferably used only for intermittent duty.

The second circuit responds to trip and close switches which can be closed for a second or left closed and will permit proper operation of the control switch relay. Closing of either the trip or close switch causes the shaft to index to a desired position, remain there for one second and then automatically return to the off position.

In the third control circuit of this invention, the shaft and contacts follow the operation of the trip and close switches, that is, the contacts remain in the close or trip position if the close or trip switch respectively, is left actuated. The contacts are opened when both trip and close switches are opened. Even if both switches are left closed, overheating of the rotary solenoid is prevented by reducing power to the rotary solenoid. Both the second and third circuits avoid any possibility of unwanted cycling action of the switch.

Rapid actuation and slow release time of the rotary solenoid can be designed into the circuits. Minimized cost and expense with maximized switching ability and versatility are present in the control switch relays controlled by the circuits of the present invention.

BRIEF DESCRIPTION OF THE DRAWINGS

The above and other objects, features and advantages of the present invention will be better understood from the following specification when read in connection with the accompanying drawings in which:

FIG. 1 is a side view of a control switch relay in accordance with a preferred embodiment of the present invention;

FIG. 2 is a front view thereof;

FIG. 3 is a partially semidagrammatic cross sectional view through line 3—3 of FIG. 1;

FIG. 4 is a cross sectional view taken through line 4—4 of FIG. 1;

FIG. 5 is a cross sectional view taken through line 5—5 of FIG. 4;

FIG. 6 is a cross sectional view taken through line 6—6 of FIG. 5;

FIGS. 7 and 8 are views similar to FIG. 4 showing the basic elements of the combination in two different operative positions;

FIG. 9 is a semidiagrammatic circuit diagram of a first control circuit of this invention;

FIG. 10 is a partial view of a modified cam in a combination of an alternate embodiment of this invention;

BRIEF DESCRIPTION OF PREFERRED EMBODIMENTS

Figure 11:
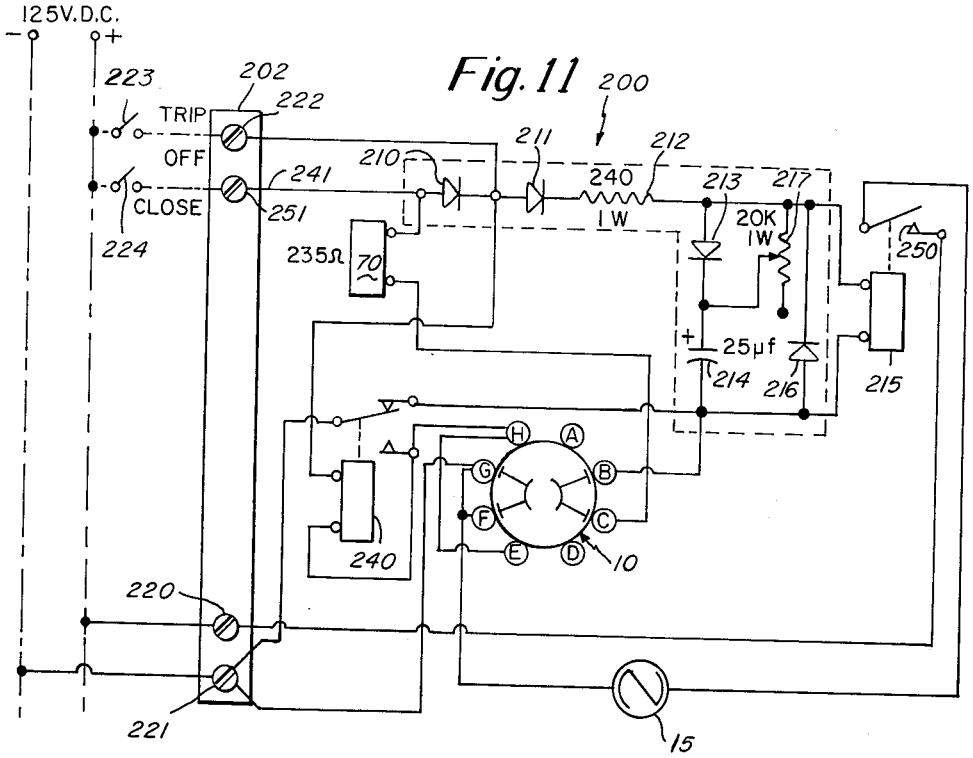
FIG. 11 is a semidiagrammatic circuit diagram of a second control circuit useful with the control switch relay of FIG. 1.

With reference now to the drawings and more particularly FIGS. 1–4, a control switch relay is illustrated generally at 10 and has a conventional switch body 11 carrying a switch shaft 12 passing through a front indicator panel 13 to the rear of the body 11. An automatic remote actuation section 14 has a rotary solenoid 15 mounted on a base mounting plate 16.

The body portion 11 is substantially conventional in known rotary relay switches and comprises plastic discs 20 held together by four through rods 21 and associated nuts 22. The switch shaft 12 preferably has a square cross section with an actuating handle 23 at one end and an inner end 24 passing through an end plate 25 having a conventional torsion spring 26 resiliently biasing the shaft into the neutral position shown in FIGS. 1–4. Rotation of the handle 23 either clockwise or counterclockwise is against the force of spring 26 which tends to return the shaft to the position shown in FIGS. 1–4. The shaft 12 carries momentary contacts 27, 27' shown in full line in FIG. 3 in a rest or first position and in dotted line at 28, 28' in a second or clockwise rotational position with a third counterclockwise position being indicated at 29, 29'. Positions 28, 28' and 29, 29' are momentary contact positions. Suitable outer contacts 30 as known in the art interconnect with the positions 28 and 29 as is well-known. In a specific embodiment of this invention, 8 rows of contacts are spaced at 45 degree intervals about the circumference of the circular body section 11 with 7 contacts in each row. The number of contacts can vary depending upon the particular usage of the device.

Bolts 33 with enlarged diameter space sleeves 34 mount a front plate 35 to which is screwed a U-shaped housing section 36 held in place by set screws 37 suitably positioned about the device. A conventional front plate 13 mounts a trip signal 39 as known in the art.

The above-described elements are substantially as previously used by the art in control and circuit breaker switches of this type.

Turning now to the automatic remote section 14, base mounting plate 16, carries lugs 50 and 52 with associated spacer sleeves 51 and 53 respectively for firmly holding in place a rotary solenoid 15 which acts as the principal source of mechanical drive power for remote operation of the switch 10. In the preferred embodiment, the rotary solenoid is an 18.96 ohm solenoid. Rotary solenoids are selected because inherently these devices are highly efficient in their conversion of electrical energy to mechanical energy. A great deal of mechanical power is provided with the solenoid taking up a relatively small space. Such solenoids are capable of rapid operation in the nature of 20 milliseconds and can deliver for example 45 inch/pounds of torque. As is known, such rotary solenoids have an output rotation of a fixed angle in one direction only, that is, they are uni-directional drives.

An output shaft 54 of the solenoid comprises part of a drive means which includes a drive arm 55 capable of reciprocal angular movement in the direction of arrow 56 (FIG. 7). The drive arm 55 is fixed to the output shaft 54 and biased to the rest position shown in FIG. 4 by a spring 57 attached to a post 58 on the base plate and a hook end of bolt 59 of the drive arm. A drive roller 60 is mounted for rotation about a roller pin 61 having ends extending into opposed side slots 62 and 63. A spring loaded extension 64 has side arms 65 in a U shape with circular cutouts 66 engaging the roller pin 61 at either end thereof. The member 64 is spring biased by a spring 67 mounted in the arm 55 by a mounting block 68. Spring 67 constantly urges member 64 with associated roller pin 61 into the outer extreme end of the slots 62, 63. When a force is applied in the direction of arrow 69 (FIG. 6), the roller and associated pin will slide in the slots 62, 63 to the inner end thereof allowing rotation of the roller at either extreme of the slots 62, 63.

A linear solenoid 70 is fixedly attached to the base mounting plate 16 and has a metal bent leaf member 71 which is substantially rigid and bent back on itself as at 72. Member 71 is mounted by a slide block 73 for reciprocal motion in the direction of arrows 74. The rest position of the linear solenoid 70 is shown in FIG. 4 and FIG. 8 with the roller biased to its outermost position by the spring 67. When the linear solenoid 70 is actuated, it slides member 71 toward itself thereby causing end 72 to push the roller 60 against the bias of spring 67 to the position shown in FIG. 7.

The switch shaft 12 has a cam profile means 80 fixed to it and mounted adjacent the roller 60 with a first cam profile surface 81 and a second substantially mirror image cam profile surface 82 adapted to be engaged by the roller 60 in alternate positions of the roller 60 as shown in FIGS. 7 and 8. Surfaces 81 and 82 differ slightly in slope to obtain substantially the same mechanical output of the cam in either direction of movement. Clockwise or counterclockwise rotation of the cam means 80 causes corresponding rotation of the switch shaft 12. Cam 80 has a center line 17 (FIG. 4) which in the at rest position of the cam and solenoid 70, passes slightly to the right side of the axis of roller pin 61 as shown in FIG. 4. In the activated position of the solenoid 70, the roller pin 61 is moved so that the fixed center line 17 now appears slightly to the left of the center line of roller pin 61. Thus, if the drive arm 55 is actuated when the roller pin is in the position of FIG. 4, the cam will rotate the shaft as shown in FIG. 8 while if the drive arm is actuated when the solenoid 70 is actuated with the roller in the position shown in FIG. 7, the shaft will be rotated counterclockwise rather than clockwise.

A detent 90 in the form of an L-shaped dog is mounted for rotation about a post 91 retained on the base mounting plate 16. One arm of the detent 90 carries a rotatably mounted detent roller 92 adapted to engage a notch 93' in the cam. The detent 90 is resiliently urged against the cam at all times by a spring 94' mounted to a fixed post 95 extending from the base mounting plate 16. Thus, the detent 90 positively positions the cam in the at rest position with the center line 17 in a fixed position with respect to the roller 60. This is important since the center line 17 must always come to substantially the same position in order to enable selective actuation by the roller in either of the roller positions. Preferably the axially extending center line of each of slots 62 and 63 are perpendicular to the center line 17 which substantially eliminates the possibility of the roller striking the point of the cam in normal operation. In the preferred embodiment, a clearance of 0.02 inch between the cam peak 300 and the roller 60 occurs during the transition from one slot extreme to the other.

In the preferred embodiment, the rotary solenoid has an output of 25 degrees, thus, the drive arm 55 indexes 25 degrees between center line 93 (FIG. 4) in the at rest position and center line 94 in the activated positions of FIGS. 7 and 8. The roller 60 is spring loaded so that its center of rotation lies 3/32 inch of the center line 17 in the at rest position of FIG. 4. When indexing 25 degrees, the roller pin 61 moves out away from the center line 17 reaching a maximum distance when it is coincident with a center line halfway between center lines 93 and 94. Thus a center line halfway between 93 and 94 is perpendicular to center line 17 of the cam profile. The advantage of this arrangement causes the pin 61 to move in what nearly approaches a straight line which in turn is parallel to the center line 17. This provides a minimum change in the drive momentum, that is, inch-/pounds/torque delievered to the cam for clockwise and counterclockwise rotation. A potted circuit 100 for activating the solenoids, is mounted between plates 16 and 35 with leads 101 attached to a terminal block 102.

The mechanical operation of the parts upon electrical actuation as will be described, is relatively uncomplicated. The at rest position is shown in FIG. 4 where the cam switch shaft 12 is in its resiliently biased neutral position locked positively in place by the detent 90. Drive arm 55 is in its at rest position as shown in FIG. 4 and slight spring pressure (2–3 ounces) urges the roller 60 into its outermost position. If it is desired to move the drive shaft 12 and associated contacts counterclockwise, suitable circuitry is activated to rotate the drive arm 25 degrees as shown in FIG. 8. This causes roller 60 to contact cam surface 81 and rotate the cam 45 degrees counterclockwise. The rotary solenoid holds the cam at 45 degrees until it is deenergized. It is preferred to keep the control switch relay energized for 3 seconds to simulate what would normally be encountered in manual operation. The roller pin is captive in the slots 62, 63 and thus roller 60 contacts surface 81. The roller 92 rides along the rear cam surface of the cam 80. Upon deactuation of the rotary solenoid, the resilient spring pressure brings the cam 80 back to the at rest position of FIG. 4 while the spring 57 aids in bringing the drive arm back to its at rest position shown in FIG. 4. During the rotational movement of the drive arm, roller 60 is held in place by the high force of the driving action as well as a few ounces of spring bias which spring bias has little effect during the driving action.

When it is desired to move the shaft clockwise, it is necessary to first actuate the linear solenoid 70. This slides the member 71 so that end 72 moves to the right as shown in FIG. 5 sliding the roller pin 61 in the slots 62, 63 against the force of spring 67. While the member 71 is maintained at its rightmost position, the arm 55 is actuated to its rotational movement by the rotary solenoid causing cam surface 82 to be engaged whereupon the roller 60 is locked in its innermost position by the driving force with the action occurring as shown in FIG. 7.

In each mode of operation described above, resilient spring pressure returns the parts to the at rest position. FIG. 10 shows an alternate embodiment of the invention in which the spring loaded detent 90 is used to lock the switch shaft in a desired position. All parts are identical to those described above except that the cam 80 is provided with two additional opposed locking notches 110 and 111. The notches are arranged so that 90 degree rotation of the shaft 12 during manual operation will allow 111 or 110 to engage roller 92 for locking depending upon the direction of movement of the cam and hold the switch in fixed position. The manual feature allows movement to 90 degrees and/or 270 degrees to get the same contact actuation as 45 degrees or 315 degrees respectively with locking in place rather than momentary contact. The switch can then be manually operated to return it to the rest position. Locking motions of this type are sometimes desired in syncroscope as known in the art.

Turning now to a first circuit associated with the control switch relay in accordance with the preferred embodiment of this invention as shown in FIG. 9, the terminal block 102 carries constant power supply terminals 120 and 121 along with separate input terminals 122 and 123. Terminals 120 and 121 are connected to 125 volt direct current power source. A switch at a remote location (124) enables selection of trip and close circuitry.

The trip circuit runs through line 125 to a 120 ohm, 1 watt resistor 126 interconnected with a two state bistable means in the the form of a relay 127 for closing a normally opened switch 128. The relay 127 has one connection to line 129 carrying one side of a charging means in the form of a condenser 130 connected back to line 125 through a 20,000 ohm, 1 watt resistor 131 forming a part of a high resistance path when the capacitor 130 is discharged. The capacitor 130 in the preferred embodiment is a 100 microfarad, 150 WDC capacitor (electrolytic). A unilateral conductive device such as a forwardly biased 600 PIV, 1 amp diode 132 is interconnected between line 125 and the capacitor 130. The lead from the diode passes back through a voltage divider in the form of resistors 133 and 134 to terminal 120. Line 129 includes a forwardly biased diode 135 which can be a 600 PIV, 1 amp diode. A contact 136 is located in the negative line 129.

The rotary solenoid 15 is actuated upon closure of the normally opened switch 128 by the relay 127.

The close circuitry includes line 140 from contact 123 to the linear solenoid 70 which is interconnected with a negative line 129. A unilateral conduction device in the form of a back-biased 600 PIV, 1 amp diode 141 is interconnected with line 140 passing to line 125.

The circuit 100 requires only four wires to be connected to the control switch relay. The operating cycle from the neutral to the trip or close position and back to the neutral position is automatic. A momentary closure of the trip switch 124 for a minimum of 50 milliseconds closes the control switch relay to index to the desired position where it remains for 3 seconds and then returns to the neutral position. When the trip position is commanded, current flows through resistor 126 charging the capacitor 130 through the forwardly biased diode 132 while resistor 126 limits the current change to 1 amp to protect the contacts of the switch. The capacitor 130 charges very quickly approaching the source value of 125 VDC. Simultaneously to the source voltage developing across the capacitor it also develops across the relay 127. The buildup of voltage across the parallel branch is in accordance with the exponential curve for charging capacitors as known in the art. At approximately 95 volts the relay 127 starts to pull in and actually closes its contact switch 128 at 118 volts. This initiates rotation of the rotary solenoid 15 and the control switch relay indexes to the trip position oepning the negative line at the control relay switch contact 136. Because the diode 132 shunts resistor 131, the capacitor 130 is fully charged when the control switch relay contact 136 opens 60 milliseconds after the switch 124 is initially closed to the trip position. This provides a fast operating time but a slow release time (3 second release). When the contact 136 opens, the capacitor 130 holds the relay 127 closed by discharging through the 5 K ohm coil resistance of the relay and the series resistor 131. This is a high resistance discharge path for the capacitor in contrast with the low resistance charging path through diode 132. Thus the circuitry allows slow release of the relay but fast operate times as in the nature of 50 milliseconds. Contact switch 136 is a normally closed switch in the 0 or neutral position and is opened by the switch shaft indexing out of neutral to either 45 degrees or 315 degrees.

Relay 127 allows for interruption of the rotary solenoid power in a manner which does not cause severe arcing problems which might otherwise be the case when switching a rotary solenoid. For remote control the command signal to the relay need only be low power allowing elimination of any line loss due to $I^2R$ over long cable runs. The relay further provides a 5 second maximum power supply to the rotary solenoid thus preventing overheating and subsequent damage to the solenoid.

It should be noted that when line 124 is in the trip position the linear solenoid does not operate because of the back-bias on diode 141 which blocks any current flow to the solenoid 70.

When switch 124 is operated to the close position, the linear solenoid 70 is actuated and by the control linkage member 71 which shifts the roller 60 to the other side of center line 17. In this position diode 141 is forwardly biased and therefore conducts. This causes current to flow through resistor 126 to operate the relay 127 as previously explained. It is important that the close position enable the linear solenoid 70 to complete its 3/16 inch travel before the rotary solenoid is energized. This enables prepositioning of the roller before mechanical force is applied by the rotary solenoid. The use of resistor 126 assures this delay. The linear solenoid completes its stroke in 10 milliseconds and the value of resistor 126 has been selected to slow down the operation of the relay 127 so that the contacts at 128 do not close for approximately 40 milliseconds providing a safety factor of 4.

Resistors 133 and 134 act as a voltage divider so that the capacitor 130 can be energized continually at for example 40 volts. This voltage serves to maintain the dielectric of the capacitor through long periods of inactivity of the control switch relay. If completely discharged for long periods of time and charged up quickly, unwanted failures of the capacitor might result. The 40 volt continuous charge is biased on two prime factors. If higher voltages are used the operating time of the relay would decrease and approach the operating time of the linear solenoid thus reducing the safety factor described above. With the capacitor continuously charged, a continuous voltage exists across the relay coil. This is less than 40 volts but also must be less than the relay dropout voltage. If it is not, any false closure of the relay contacts due to mechanical shock or vibration could result in the relay mechanically sealing in which would cause the control switch relay to index to the trip position momentarily.

Diode 135 is used to prevent a reverse polarity hookup from destroying the other diodes and electrolytic capacitor which are polarity sensitive. Reverse hookup of plus and minus only back-biases diode 135 preventing current flow and thus preventing any damage.

Turning now to a second circuit arrangement 200 for use in connection with the control switch relay 10 of the preferred embodiment of this invention, as shown in FIG. 11, terminal block 202 which replaces the terminal block of the control switch relay 10 shown at 102, carries constant power supply terminals 220 and 221 connected to a 125 volt direct current power source. Switch terminals 222 and 251 act as switch means and are connected to trip switch 223 and close switch 224 as shown. Switches 223 and 224 when closed actuate the trip and close positions of the contacts carried by the switch shaft 12. The terminals of a preferred embodiment of the control switch relay 10 are numbered A through H as shown in the following contact chart table:

| | TERMINAL | | | | | | | |
|---|---|---|---|---|---|---|---|---|
| POSITION | H | A | B | C | D | E | F | G |
| Trip | | x | x | | | x | x | |
| Off | | | x | x | | | x | x |
| Close | x | | | x | x | | | x |

Closing of switch 223 or 224 causes the switch shaft of the control switch relay 10 to index to and maintain one of its two positions (trip or close determined by which switch 223 or 224 is selected) for about one second after which it will return to the neutral (off) position and be prevented from further operation until switch 223 or 224 is momentarily opened.

FIG. 11 shows the circuit diagram which includes in the trip circuit a unilateral conductive device in the form of diodes 210 and 211 in series with a 240 ohm, 1 watt resistor 212 leading through diode 213 to a 25 uf, 150 V.D.C. capacitor 214 in parallel with a bistable device.

The bistable device is in the form of a relay 215 having in parallel therewith a unilateral conductive device 216. All of the diodes, 210, 211, 216 and 213 are 600 P.I.V. 1 amp diodes.

A 20K ohm, 1 watt variable resistor 217 spans the line between the charging or capacitor means 214 and the line leading to diode 216. The 5K ohm, S.P.S.T., relay 215 is interconnected with the rotary solenoid 15 which is in turn connected to the terminal of the control switch relay as indicated in the table and on the drawing. A second two-state bistable means in the form of an 8K ohm, S.T.D.T. relay 240 is used to interconnect terminal 221 with relay 215, as will be described, and a contact of the relay is interconnected with the line between diodes 210 and 211 as shown. The linear solenoid 70 which preferably has a value of 235 ohms, is interconnected with the close switch line 241 and terminal C of the control switch. The drawing at FIGS. 11 and 12 clearly indicates the electrical wiring between components.

Turning now to the operation of the circuit 200, when the trip position is commanded as by closing switch 223, current flows through diode 211 and resistor 212 charging the capacitor 214 through the forwardly biased diode 213. Resistor 212 limits the charge current to less than 1 amp in order to protect the contacts of the trip switch 223 from too high a current load. The trip switch remains in the closed position throughout the following explanation. Capacitor 214 charges up quickly and quickly comes to a value approaching the source voltage with a simultaneous source voltage value developing across the leads of the relay 215. The buildup of voltage across the parallel branch is in accordance with the known exponential curve for charging capacitors. When the voltage is sufficient to close the contacts 250 of the relay 215, the rotary solenoid 15 is energized which causes the shaft of the control switch relay to move to the trip positioning opening the contacts B–C. Since diode 213 shunts resistor 217, the capacitor can be fully charged when the control switch relay contacts B–C open, which occurs 50 milliseconds after the trip switch 223 initially closes. This provides the control switch relay 10 with a fast operating time yet gives it a slow release time.

When contacts B–C open, capacitor 214 holds the relay 215 closed and actuated by discharging through the 5000 ohm coil resistor and the series resistor 217. This is a high resistance discharge path for the capacitor compared with the low resistance charge path through the shunt diode 213 thus the relay remains operated for ½ second or thereabouts. This holds the shaft of the control switch relay 10 in the trip position, closing contacts F–E, this in turn closes the contacts by energizing the coil, of relay 240 which contacts are single pole, double throw contacts. When the contact of the relay 240 closes the relay effectively seals in by establishing a negative battery in the coil circuit of the relay 240. This is a parallel circuit to the negative battery already established by closing of contacts F–E. Relay 215 releases after about 1 second deenergizing the rotary solenoid and allowing the control switch relay to spring return back to its neutral position as shown in FIG. 11. However, the relay 240 remains operated with its contact closed and relay 215 cannot be operated again until switch 223 is opened momentarily to break the seal in of the relay 240 thus allowing 240 to release and reclose its normally closed contact thus completing the negative side of the relay 215 coil circuit. If switch 223 is not opened, the control switch relay remains in the neutral position (off) and further remote operation of the control switch relay cannot be carried out.

Diode 211 insures that the energy in capacitor 214 will discharge through the relay 215 to cause a slow release time while preventing discharge through the parallel relay coil circuit 240 prior to the relay 240 opening its normally closed contact. This diode further protects resistor 212 from excessive current flow in the event that a reverse polarity hookup is made at the terminal block 202.

Diode 216 protects the capacitor 214 from reverse voltage transient generated when relay 215 is deenergized. The reverse voltage generated across the relay coil by the collapsing magnetic field is dissipated through diode 216 thus it does not appear at the negative plate of the capacitor and this eliminates possible premature capacitor failure.

When only the trip switch is closed to cause the control switch relay 10 to index to the trip position, the linear solenoid 70 does not operate due to the back bias on diode 210 which blocks any current flow through the coil of the linear solenoid.

When close switch 224 is closed, the linear solenoid 70 operates. This causes a shift in the control switch relay mechanical drive system that causes the rotary solenoid to index the control switch relay 10 to the close position when it is energized. However, in this case, diode 210 is forwardly biased and does allow passage of current. The current then flows through diodes 210, 211 and resistor 212 to operate the coil of the relay 215 as previously described.

The control switch relay contacts G–H complete the coil circuit of the relay 240 when the switch 10 indexes to the close position. The relay 240 then closes its normally open contacts sealing it in. The seal in is maintained until deactuation of the close switch 224 to break the seal in circuit.

For proper operation of the switch 10 to the close position, the linear solenoid must be complete its mechanical shift of the roller before the rotary solenoid is energized. Resistor 212 insures this action. As the linear solenoid completes its stroke to shift the roller in about 10 milliseconds, the resistance 212 slows down the operation of relay 215 so that its contacts will not close for approximately 30 milliseconds. This delay gives a safety factor of at least 3 in the circuit to insure that the linear solenoid will always complete its stroke before the closing of normally open contact 250.

Figure 12:
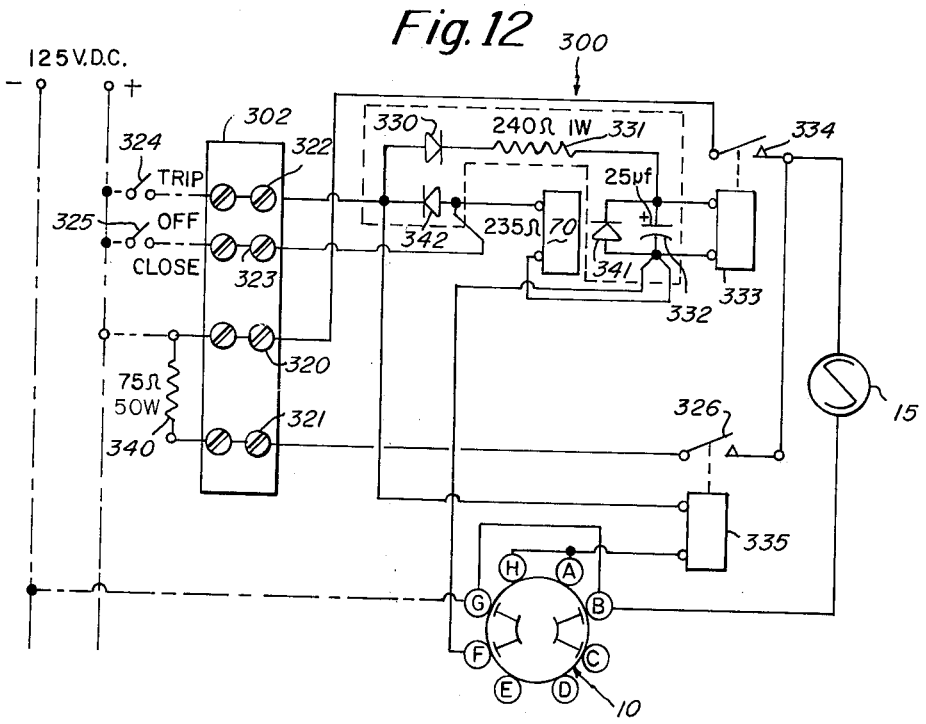
FIG. 12 is a semidiagrammatic circuit diagram of a third control circuit useful with the control switch relay of FIG. 1.

Turning now to a third control circuit means for use with the control switch relay in accordance with the preferred embodiment of this invention, as shown in FIG. 12, a terminal block 302 substantially similar to blocks 102 and 202, carries constant power supply terminals 320, 321 with input terminals 322, 323 substantially as previously described. Switches 324 and 325 act as trip and close switches respectively and are connected to 125 volt direct current power source.

The control switch relay 10 has contacts A–H as diagrammatically indicated in the drawing for interconnection with the two contacts as shown arranged about the center shaft of the switch. The table shows the trip, off and close position of the contacts carried by the switch shaft 12.

| | TERMINAL | | | | | | | |
|---|---|---|---|---|---|---|---|---|
| POSITION | H | A | B | C | D | E | F | G |
| Trip | | x | x | | | x | x | |
| Off | | | x | x | | | x | x |
| Close | x | | | x | x | | | x |

The circuit 300 is designed to permit intermittent duty of the control switch relay 10. Operation of the trip switch or close switch, causes the control switch relay 10 to index to the trip or close position respectively and remain there until switches 324 or 325 are open which for preferred circuit design does not exceed 15 seconds closed at any one time.

Following the circuit operation, when the trip position is closed by closure of switch 324, current flows through a unilateral conductive device in the form of diode 330 and resistor 331, having a valve of 240 ohms, 1 watt, to charge the charging means in the form a 25 uf, 150 V.D.C. condenser 332. Resistor 331 limits the charge current to less than 1 amp in order to protect the contacts of the trip switch 324. The condenser 332 charges very quickly and rapidly approaches the same voltage as the source. Simultaneously this charge voltage substantially develops across a two-state bistable means in the form of the 5000 ohm S.P.S.T. relay 333 having a normally opened contact 334. The buildup of voltage across the parallel branch including the condenser 332 and the relay 333 is in accordance with the exponential curve for charging capacitors as is known.

When the voltage buildup is sufficient to operate the relay 333, the contacts 334 close and energize the 18.96 ohm rotary solenoid 15. This in turn indexes the switch 10 to the trip position opening the contacts G–F and closing the contacts A–B. This removes negative battery from the parallel circuit which includes capacitor 332 and the relay 333 and starts to release the contacts 334 and establishes negative battery to a second 5K ohm. S.P.S.T., relay 335 causing it to close its normally opened contact 336. The energy stored in the condenser 332 discharges through the relay coil of relay 333 and delays the release of the relay contacts 334 until after the relay 335 closes the contact 336. When the contact 334 opens the rotary solenoid circuit from terminal 320 of the terminal block 302, a parallel circuit to the rotary solenoid has already been established from terminal 321 through the contacts 326 of relay 335. This acts as a hold in circuit greatly reducing the power to the rotary solenoid by feeding it through the series dropping resistor 340 (75 ohm 50 watt). The electric power drops from approximately 800 watts required to drive the control switch relay 10 to the trip or close position to approximately 33 watts to hold it in position. Because the rotary solenoid can easily dissipate the reduced power, it does not overheat and therefore can be left energized for longer periods of time while holding the control switch relay in a position. When switch 324 is opened, the coil circuit of relay 335 is deenergized thus breaking the hold in circuit and the control switch relay has the contacts returned to the neutral position by the return spring action on the shaft 12 of the switch 10.

Diode 330 protects the resistor 331 from excessive current flow in the event that a reverse polarity hookup is made at the terminal block 302.

Diode 341 is in parallel with the condenser 332 to protect it from reverse voltage transient generated when the relay 333 is deenergized. The reverse voltage generated across the relay coil by the collapsing magnetic field is dissipated through diode 341 and thus does not reach the negative plate of the capacitor which aids in avoiding possible capacitor failure.

When switch 324 is closed causing the control switch relay 10 to index to the trip position, the linear solenoid 70 does not operate since there is a back bias on diode 342 blocking any current flow. The diodes 330, 341 and 342 are all 600 P.I.V. 1 amp diodes.

When the close switch 325 is operated to the close position, the linear solenoid 70 is actuated. This causes a shift in the control switch relay mechanism drive system that will cause the rotary solenoid 15 to index the control switch relay 10 to the close position when it is energized. However, when this happens, diode 342 is forwardly biased and does allow conduction of electricity. This allows the current to flow through diode 342, 330 and resistor 331 and thus operates the relay 333. This in turn causes the control switch relay 10 to index to the closed position which opens contacts F–G and closes contacts G–H. This causes the relay 333 to start to release and open its contacts 334 while the second relay 335 operates to close contacts 336 and establishes the rotary solenoid 15 hold in circuit through resistor 340 as previously explained.

For proper operation of the control switch relay 10 to the close position, the linear solenoid 70 should complete its mechanical shift, i.e. its full linear stroke before the rotary solenoid is energized. The resistor 331 slows the current flow to slow actuation of relay 333 and insures actuation of the linear solenoid 70 prior to operation of the rotary solenoid 15. This action is substantially as described with respect to resistor 212 in the arrangement of FIG. 11.

While specific embodiments of the present invention have been shown and described above, modifications are possible. Roller 60 could be a ball bearing or sliding surface if desired although a roller is preferred. The particular values of the electrical components and the circuitry used can vary depending upon the particular application. Similarly the number of contacts in the switch 10 and the purpose of the switch 10 can also vary as may be required for particular applications.

The trip and close switches described are not necessarily on-off switches. The terminals of the circuits can be interconnected with any means such as another circuit which provides electrical power or no power to the trip or close terminals. In commercial operations the power supply wiring and switches therefor which are interconnected with the terminal blocks of FIGS. 9, 11 and 12 are normally supplied by the user. The close and trip switches or contacts of FIGS. 9, 11 and 12 are preferably actuated so that only a close or trip circuit is in operation at any one time.

What is claimed is:

1. A control circuit means for operating a remote controlled switch comprising a rotary solenoid positioned to engage a switch shaft carrying radially positioned contacts, and a linear solenoid, said circuit means comprising trip switch means and close switch means for interconnection with means for supplying a trip power input or close power input respectively, first relay means responsive to actuation of one of said trip switch means or close switch means to actuate said rotary solenoid and index said shaft to a preselected position, hold said position for a preselected time and then return to its original position regardless of whether or not said trip switch means or close switch means is deactuated, second relay means for deenergizing said first relay means to prevent further actuation of said first relay means until deactuation of said trip or close switch means.

2. A control circuit means in accordance with claim 1 wherein said trip switch means is in series with a first unilateral conduction means and a first resistor, and a first parallel branch carrying series aligned second unilateral conduction means in series with a charging means, with a second parallel branch carrying a third unilateral conduction means permitting current flow opposite to the direction of current flow permitted by said first and second unilateral conduction means, and with said first relay in parallel with said first and second parallel branches.

3. A control circuit means in accordance with claim 2 wherein all said unilateral conduction means are diodes and said charging means is a capacitor.

4. A control circuit means in accordance with claim 3 and further comprising a second resistor interconnected with one lead between said diode and capacitor in said first branch and a second lead between said first and second branch whereby said capacitor can be fully charged rapidly and said relay rapidly actuated to give rapid actuation of said solenoid with a slow release time.

5. A control circuit means in accordance with claim 4 wherein said close switch means is in series with a fourth diode which is in turn in series with said diode, resistor and other components of said trip switch circuit means.

6. A control circuit means in accordance with claim 5 and further comprising said linear solenoid having one lead interconnected in said control circuit means before said fourth diode and a second lead interconnected with a negative power means, with said first resistor assuring that actuation of said linear solenoid always occurs prior to actuation of said rotary solenoid.

7. A control circuit means in accordance with claim 6 wherein said rotary solenoid when actuated drives said switch shaft in one direction when said linear solenoid is not actuated and in a second direction when said linear solenoid is actuated.

8. A control circuit means for operating a remote controlled switch comprising a rotary solenoid positioned to engage a switch shaft carrying radially positioned contacts, and a linear solenoid, said control circuit means comprising trip switch means and close switch means for interconnection with means for supplying a trip power input or close power input respectively, first relay means responsive to actuation of one of said trip switch means or close switch means to actuate said rotary solenoid and index said shaft to a preselected position, and means for maintaining electrical power to the rotary solenoid to hold said shaft in said preselected position until said switch means is deactuated whereby said rotary solenoid actuation and deactuation is responsive to the operation of said trip or close switch means.

9. A control circuit means in accordance with claim 8 wherein said maintaining means comprises a hold in circuit having a second relay means for reducing power to said rotary solenoid at a preselected time after power is passed to said rotary solenoid from said trip switch means or said close switch means.

10. A control circuit means in accordance with claim 9 and further comprising resistor means in series with said rotary solenoid upon actuation of said second relay means.

11. A control circuit means in accordance with claim 10 and further comprising means for delaying actuation of said rotary solenoid until said linear solenoid is actuated when said close switch means is actuated.

12. A control circuit means in accordance with claim 11 wherein said linear solenoid actuates a mechanical means that determines direction of switch shaft movement upon actuation of said rotary solenoid.

13. A control circuit means in accordance with claim 12 wherein said trip switch means is in series with a first diode, first resistor and a branch circuit having a second diode biased opposite to the bias of said first diode in parallel with a capacitor and in parallel with said first relay means.

14. A control circuit means in accordance with claim 13 and further comprising a third diode blocking current flow from said trip switch means to said linear solenoid and permitting current flow from said close switch means to operate said first relay means after actuation of said linear solenoid.

15. A control circuit means in accordance with claim 14 and further comprising said preselected time corresponding to the time required for said switch shaft to move to either of two preselected positions.

* * * * *